United States Patent [19]

Loeffler et al.

[11] Patent Number: 5,044,890

[45] Date of Patent: Sep. 3, 1991

[54] FUEL INJECTION PUMP FOR INTERNAL COMBUSTION ENGINES

[75] Inventors: Alf Loeffler, Markgroeningen Talhausen; Wolfgang Fehlmann; Eberhard Fiedler, both of Stuttgart; Wolfgang Geiger, Remshalden Grunbach; Helmut Laufer, Gerlingen, all of Fed. Rep. of Germany

[73] Assignee: Robert Bosch GmbH, Stuttgart, Fed. Rep. of Germany

[21] Appl. No.: 544,561

[22] Filed: Jun. 27, 1990

[30] Foreign Application Priority Data

Aug. 30, 1989 [DE] Fed. Rep. of Germany ..... 3928718

[51] Int. Cl.[5] ..... F04F 5/00; F02M 37/04

[52] U.S. Cl. ..... 417/87; 417/151; 123/449; 123/503

[58] Field of Search ..... 123/41.31, 449, 503, 123/557; 137/576; 417/151, 85, 87

[56] References Cited

U.S. PATENT DOCUMENTS

| | | | |
|---|---|---|---|
| 4,084,564 | 3/1978 | Rickert | 123/43.31 |
| 4,364,355 | 12/1982 | Karino | 123/43.31 |
| 4,532,893 | 8/1985 | Day et al. | 123/43.31 |
| 4,763,611 | 8/1988 | Kobayashi | 123/43.31 |
| 4,869,218 | 7/1988 | Fehlmann et al. | 123/357 |
| 4,873,956 | 12/1987 | Fehlmann et al. | 123/357 |
| 4,886,031 | 12/1989 | Scheurenbrand et al. | 417/151 |
| 4,926,829 | 5/1990 | Tuckey | 137/576 |

*Primary Examiner*—Leonard E. Smith
*Assistant Examiner*—Michael I. Kocharov
*Attorney, Agent, or Firm*—Edwin E. Greigg; Ronald E. Greigg

[57] ABSTRACT

A fuel injection pump for internal combustion engines that has a pump interior and a final control element chamber, separated from it, the latter having an electric final control element for actuating a quantity adjusting device that determines a fuel injection quantity, parts of the final control element from which a control variable for the injection quantity is derived and which thereby serves as a material measure, are to be protected from the influence of fuel. By means of a jet pump through which a permanent propulsive flow flows and which is part of a flow conduit, the static pressure at the intake bore of the jet pump that communicates with the final control element chamber is lowered, and this negative pressure is utilized for evacuating the fuel entering the final control element chamber in the form of a leakage flow along the bearing of a control shaft. This arrangement is particularly suitable for high-pressure injection in Diesel engines, to attain highly accurate fuel metering that is stable over a long period of time.

8 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines as defined hereinafter. In such a fuel injection pump, the quantity of fuel supplied to the injection nozzles per pump piston stroke and there attaining injection into the cylinders of the engine is metered precisely by means of an electrical final control element. It has been found that the accuracy with which the fuel quantity can be metered depends not only on the constancy in material properties of the fuel supplied, but also on the functional capability of the final control element.

In a known fuel injection pump of this generic type (German Offenlegungsschrift 37 39 198; U.S. Pat. No. 4,869,218) the temperature of the fuel delivered to the injection nozzles is ascertained by moving a flow of fuel, which is permanently diverted from the pump interior, and the temperature of which is at a known ratio to the temperature of the fuel supplied to the injection nozzles by the pump piston, past a temperature sensor; the output signal of the temperature sensor is used as a corrective variable in the control variable supplied to the electric final control element for actuating the quantity control device.

However, this does not take into account the fact that the values of the control variables supplied to the control unit entail systematic errors, if the electrical parts of the final control element that embody the measurement, such as the potentiometer resistor tracks that are to be scanned by wipers and are exposed to the fuel, are altered by the fuel, and in particular if fuel additives, which are increasingly used and the composition and effects of which are increasingly complex, cause these parts to undergo an incalculable drift over time, bringing about an incorrect setting in fuel metering.

In a fuel injection pump known from German Offenlegungsschrift 37 04 578; U.S. Pat. No. 4,873,956, the attempt is made to keep additives, in the Diesel fuel that reaches the final control element chamber, away from it by providing that the control element chamber communicates with the pump interior only via a narrow bearing gap on the final control element shaft.

In particular, this is intended to keep the water, which causes corrosion in the parts of the final control element carrying an electric potential, away from the final control element chamber.

A close bearing fit, which is necessary to attain this object, and deposits resulting from fuel additives, can on the one hand impair the function of the final control element as a result of friction; on the other, additives can once again settle on the potentiometer, which is likewise disposed in the final control element chamber, so that not only do they adulterate the electrical values but they also cause corrosion.

OBJECT AND SUMMARY OF THE INVENTION

The fuel injection pump according to the invention has an advantage over the prior art that the problem discussed above is reliably solved. The final control element chamber, which includes the electrical final control element, has a flow conduit bordering it, which is partly embodied as a jet pump that in turn communicates via an intake bore with the final control element chamber.

As a result, leaking fuel entering the final control element chamber from the pump interior is aspirated away by the negative pressure produced by the jet pump, and the final control element chamber and in particular the parts in it that carry an electrical potential are kept free of fuel. The parts of the final control element carrying the electrical potential are thus no longer in contact with the fuel and no further change in the material measure formed by them from direct contact with the fuel can occur.

The overly narrow bearing play present in the prior art, which leads to hysteresis errors in positioning the quantity adjustment device because of sluggishness of the control shaft, is avoided by the invention; moreover, because of the acceptance of a leakage along the bearing of the control shaft that does nor exceed the pumping capacity of the jet pump, it becomes possible to manufacture the control shaft with finer tolerances.

The invention will be better understood and further objects and advantages thereof will become more apparent from the ensuing detailed description of preferred embodiments taken in conjunction with the drawings.

BRIEF DESCRIPTION OF THE DRAWINGS

The drawings are longitudinal sections of the final control element chamber with the electric final control element of the fuel injection pump.

DESCRIPTION OF THE PREFERRED EMBODIMENTS

Figure 1:
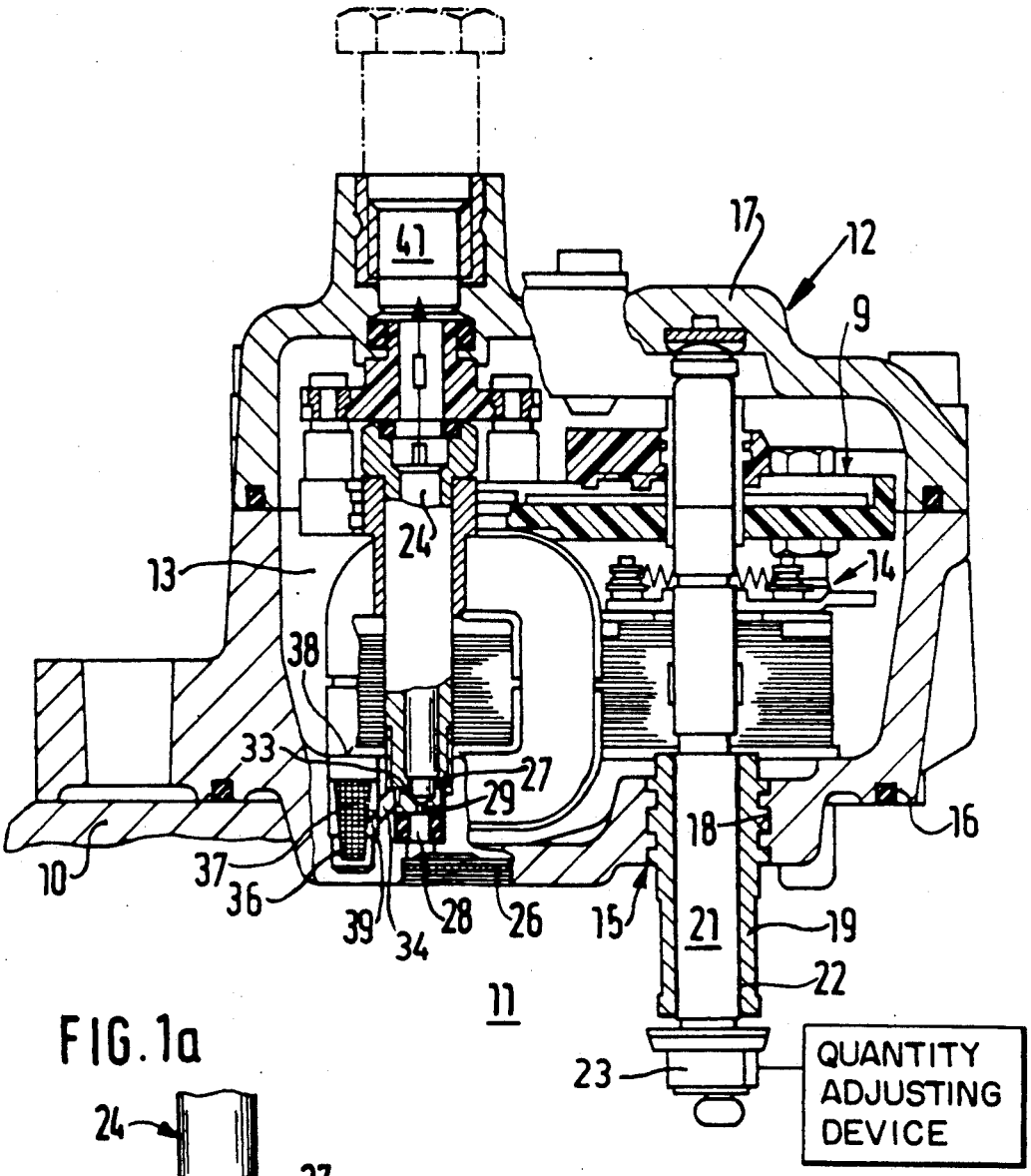
FIG. 1 shows the first exemplary embodiment with the final control element chamber still partly filled with fuel.
Figure 1A:
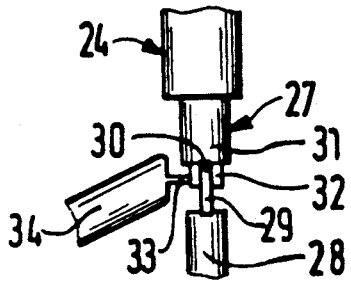
FIG. 1*a* is a detail on a larger scale of FIG. 1 showing a jet pump disposed in the final control element chamber.
Figure 2:
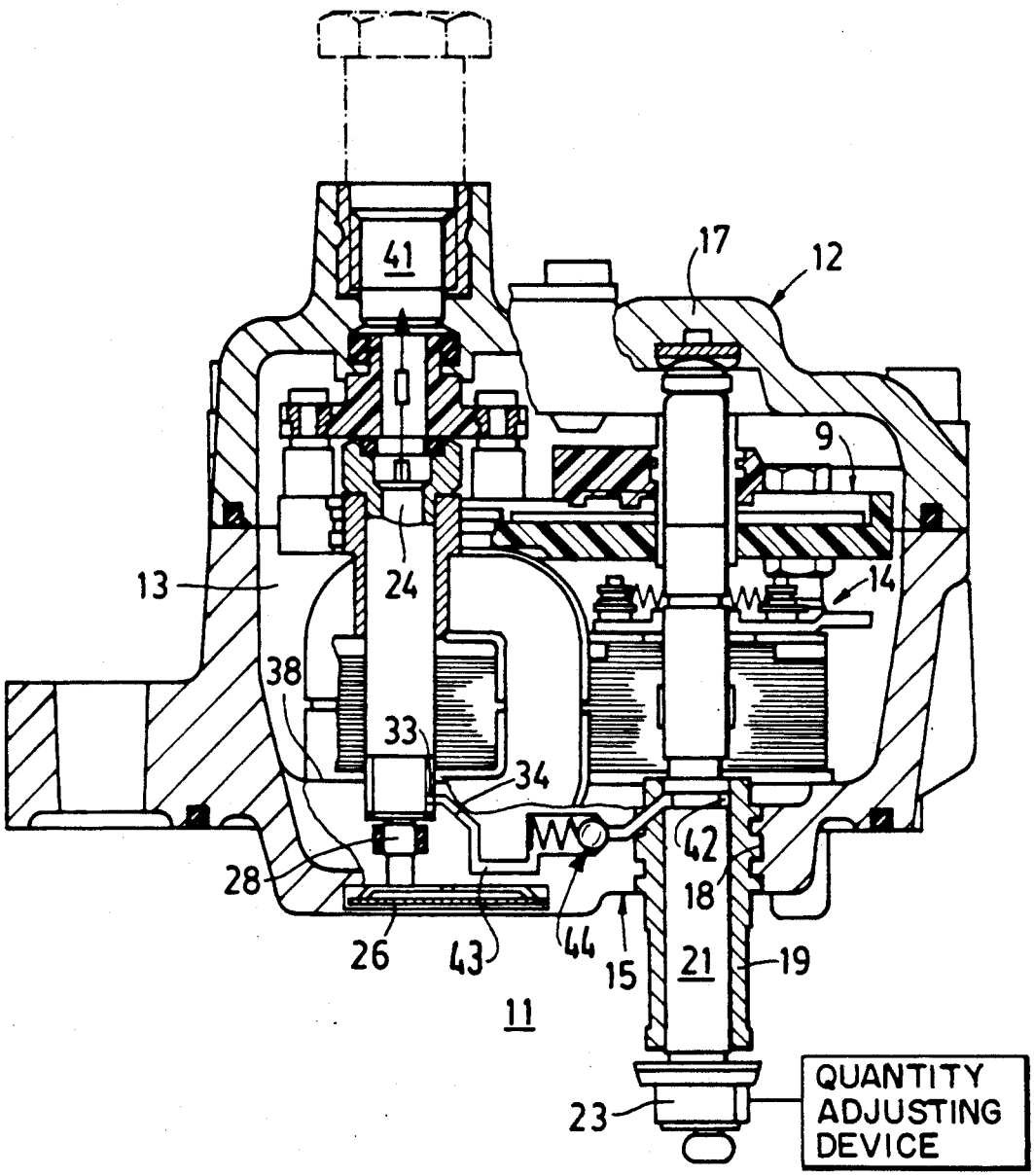
FIG. 2 shows a second exemplary embodiment with the final control element chamber completely free of fuel.

In the fuel injection pump of the distributor type for an internal combustion engine, shown in detail and in longitudinal section in FIG. 1, a pump housing 10 surrounds a pump interior 11. A final control element housing 12 divides the pump interior 11 from a final control element chamber 13, in which an electrical final control element 14 having a potentiometer 9, forming a material measure for the fuel metering of the fuel injection pump, is disposed. The final control element housing 12 is embodied in two parts and comprises a shell-like basic housing 16, with which a partition 15 borders on the pump interior 11, and which is sealed off in a fluid-tight manner from the pump interior 11, and a cap 17 screwed to the basic housing 16 and closing it off, the cap being removable for servicing.

The basic housing 16 has a recess 18 at the partition 15, in which a bushing 19 embodied as a slide bushing is inserted, as part of the partition 15. The bushing 19 extends into the pump interior 11. A control shaft 21 is guided with play in motion through the bushing 19, so that a bearing gap is created between the control shaft and the inside of the bushing 19, which gap forms a throttle restriction 22 between the pump interior 11 and the final control element chamber 13.

In the pump interior 11, the fuel is at a supply pressure of approximately 3 to 8 bar. The pressure level in the final control element chamber 13 is lower. Because of this pressure difference, a small quantity of fuel flows as a leakage flow from the pump interior 11 into the final control element chamber 13 via the throttle restriction 22.

The control shaft 21 is actuated by the final control element 14, via an eccentric 23 disposed on the face end of the control shaft 21 protruding into the pump interior 11, to position a quantity adjusting device (not shown) with which the fuel metering for the high-pressure circulation of the fuel injection pump is performed in a known manner.

Bordering on the final control element chamber 13, a flow conduit 24 is extended through the final control element housing 12; through it, fuel can flow out of the pump interior into a fuel return line, not shown.

The flow conduit 24, beginning at the pump interior 11, is provided with an inflow filter 26, and in the following section is embodied as a jet pump 27. The jet pump 27 has an inlet neck 28 adjoining the inflow filter 26, and this neck is adjoined in the flow direction by a throttle 29 embodied as a drive nozzle.

The throttle 29 is inserted with a trailing end portion 30 into a mixing chamber 31; the end portion 30, with the part of the mixing chamber 31 coaxially surrounding it, forms an intervening annular gap that represents a catch nozzle 32. Discharging into the catch nozzle 32, preferably at a right angle, is an intake bore 33 that takes on the function of an intake neck.

The intake bore 33 communicates via an end portion 34 toward the final control element with a blind bore 36 that is disposed in the wall of the basic housing 16 and forms the lowermost point of the final control element chamber 13. A suction filter 37 is press-fitted into the blind bore 36, and its inlet side 38 communicates with the final control element chamber 13, while its outlet side 39 communicates with the end portion 34 of the intake bore 33 toward the final control element.

Following the portion embodied as a jet pump 27, the flow conduit 24 continues in the flow direction until where it discharges into an overflow opening 41 embodied in the cap 17.

With the arrangement as described, the following functional course and action arise: based on the fuel entering the flow conduit 24 at the inflow filter 26 in a first exemplary embodiment, the flow speed of the fuel increases at the throttle 29, forming a driving flow; as a result, the static pressure at this point drops below the static pressure at the catch nozzle 32, so that the fuel located at the intake bore 33, forming a wake, enters the jet pump 27. The transmission of energy from the driving stream to the wake is effected in the mixing chamber 31 by pulse exchange; as a result, a fuel flow beginning at the pump interior 11 via the throttle restriction 22, the bottom of the basic housing 16, the blind bore 36, the suction filter 37, and the jet pump 27 to the overflow opening 41, which communicates with a pressure-relieved chamber comes about. As a result, filling of the final control element chamber 13 with fuel is limited to a level that is determined by the location of the inlet side 38 of the suction filter 37. The location of the inlet side 38 is selected such that the parts of the final control element 14 that carry an electrical potential and form a material measure for controlling fuel metering, are located above the inlet side 38 and thus are protected against the direct influence of fuel that could bring about a change in the material measures.

In a second exemplary embodiment, the throttle restriction 22 is closed off toward the final control element 14 with an annular groove 42 that forms a hydraulic dam, because the annular groove 42 communicates with a relief line 43 leading to the jet pump 27 and thus communicates with a point that has a lower pressure level.

A check valve 44 opening in the direction of flow from the annular groove 42 to the intake neck 33 is disposed in the relief line 43 and prevents a flow of fuel from the jet pump 27 to the annular groove 42 that does not arise during operation but when the engine is at a stop, given a suitable location of the fuel tank.

The remaining processes in the jet pump 27 proceed in a logically similar manner in the second exemplary embodiment to those of the first exemplary embodiment; as a result, an entry of fuel into the final control element chamber 13 is suppressed completely by guiding the leakage fuel in the relief line 43, so that the parts of the final control element 14 that must be protected are not impaired even indirectly via the vapor phase of the fuel.

From the two exemplary embodiments, it is possible to protect the parts of the final control element 14 carrying the electrical potential, and in particular the potentiometer 9, which form a material measure that determines a fuel metering that is definitive for the injection quantity of the fuel injection pump, against aging processes that are triggered by the fuel contact in combination with the complexly structured additives it contains, the effect of these additives being unpredictable.

This assures that even if the fuel quality is uneven, highly accurate fuel injection is attained, which is stable over a long period of time and durably minimizes the expulsion of toxic substances by the engine.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a pump housing (10), a pump interior (11) enclosed in said pump housing (10), the pump interior being filled with fuel under pressure that is supplied to a pump work chamber upon an intake stroke of a pump piston defining the pump work chamber, a quantity adjusting device disposed in the pump interior (11) for controlling the fuel injection quantity pumped by the pump piston at high pressure, a final control element housing (12), a final control element chamber (13) in said final control element housing separated from the pump interior (11), said final control element chamber communicating with said pump interior only via a throttle restriction (22), said final control element housing (12) contains an overflow opening (41), an electrical final control element (14) disposed in the final control element chamber (13), the final control element having a potentiometer (9) associated with it, a control shaft (21) guided through a partition (15) that divides the final control element chamber (13) from the pump interior (11), said control shaft is coupled to the quantity adjusting device, a flow conduit (24) that passes through the final control element housing (12) which discharges at one end into the pump interior (11) and at the other end discharges into the overflow opening (41) which leads to a fuel tank, a portion of said flow conduit (24) is embodied as a jet pump (27) with an intake bore (33) that communicates via the final control element chamber (13) with a part of the throttle restriction (22).

2. A fuel injection pump as defined by claim 1, in which said jet pump (27) adjoins a mouth of the pump interior (11) into the flow conduit (24) via an inlet neck (28), and an intake bore (33) of the jet pump (27) communicates with a lowermost point of the final control element chamber (13).

3. A fuel injection pump as defined by claim 2, in which said jet pump (27) has a throttle (29) embodied as a drive nozzle through which an overflow quantity from the pump interior flows, which throttle is adjoined in a flow direction by a chamber that is embodied as a mixing chamber (31), and the intake bore (33) of the jet pump (27) branches off from this mixing chamber.

4. A fuel injection pump as defined by claim 3, in which said intake bore has an end portion (34) toward the final control element, and said intake bore (33) communicates with a blind bore (36) in the wall of the final control element housing (12), the blind bore forming the lowermost region of the final control element chamber (13).

5. A fuel injection pump as defined by claim 4, which includes an inflow filter (36), said inflow filter (36) is press-fitted into the blind bore (36), with an inlet side (38) of the filter communicating with the final control element chamber (13) and its outlet side (39) communicating with said end portion (34) of the intake bore (33) toward the final control element.

6. A fuel injection pump as defined by claim 3, in which said jet pump (27) is connected by an end portion (34) of the intake bore (33) to a relief line (43) that communicates with the throttle restriction (22).

7. A fuel injection pump as defined by claim 6, in which said relief line (43) leads away from an annular groove (42) which closes off the throttle restriction (22) toward the final control element, which annular groove is defined by the control shaft (22) and a bearing in the partition (15).

8. A fuel injection pump as defined by claim 7, in which a check valve (44) that opens in a flow oriented direction from the annular groove (42) to the jet pump (27) is disposed in the relief line (43).

* * * * *